US007546734B2

(12) United States Patent
Dörr et al.

(10) Patent No.: US 7,546,734 B2
(45) Date of Patent: Jun. 16, 2009

(54) HOMOGENOUS MIXTURE FORMATION BY SWIRLED FUEL INJECTION

(75) Inventors: Thomas Dörr, Berlin (DE); Leif Rackwitz, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 65 days.

(21) Appl. No.: 10/933,425

(22) Filed: Sep. 3, 2004

(65) Prior Publication Data

US 2005/0050895 A1 Mar. 10, 2005

(30) Foreign Application Priority Data

Sep. 4, 2003 (DE) ..... 103 40 826

(51) Int. Cl.
*F23R 3/14* (2006.01)

(52) U.S. Cl. ..... 60/737; 60/748

(58) Field of Classification Search ..... 60/737, 60/748, 740, 743, 745; 239/403, 433, 434, 239/434.5

See application file for complete search history.

(56) References Cited

U.S. PATENT DOCUMENTS

| | | | | | |
|---|---|---|---|---|---|
| 3,091,283 | A | * | 5/1963 | Kidwell | 239/464 |
| 3,703,259 | A | * | 11/1972 | Sturgess et al. | 60/748 |
| 3,930,369 | A | | 1/1976 | Verdouw | |
| 3,955,361 | A | | 5/1976 | Schirmer | |
| 3,980,233 | A | | 9/1976 | Simmons | |
| 4,141,213 | A | | 2/1979 | Ross | |
| 4,218,020 | A | | 8/1980 | Reider | |
| 4,425,755 | A | * | 1/1984 | Hughes | 60/748 |
| 4,974,416 | A | | 12/1990 | Taylor | |
| 5,303,554 | A | * | 4/1994 | Faulkner | 60/748 |
| 5,351,475 | A | | 10/1994 | Ansart | |
| 5,373,693 | A | | 12/1994 | Zarzalis | |
| 5,479,781 | A | * | 1/1996 | Fric et al. | 60/740 |
| 5,673,551 | A | | 10/1997 | Doebbeling | |
| 5,799,872 | A | * | 9/1998 | Nesbitt et al. | 239/406 |
| 5,816,049 | A | | 10/1998 | Joshi | |
| 5,822,992 | A | * | 10/1998 | Dean | 60/737 |
| 5,966,937 | A | | 10/1999 | Graves | |
| 6,067,790 | A | * | 5/2000 | Choi et al. | 60/748 |
| 6,119,459 | A | | 9/2000 | Gomez | |
| 6,152,726 | A | | 11/2000 | Ruck | |
| 6,655,145 | B2 | * | 12/2003 | Boardman | 60/737 |
| 6,799,427 | B2 | | 10/2004 | Calvez | |
| 6,820,411 | B2 | * | 11/2004 | Pederson et al. | 60/748 |
| 7,065,972 | B2 | * | 6/2006 | Zupanc et al. | 60/748 |
| 2003/0093997 | A1 | | 5/2003 | Stalder | |
| 2004/0003596 | A1 | | 1/2004 | Chin | |
| 2004/0040311 | A1 | * | 3/2004 | Doerr et al. | 60/776 |

FOREIGN PATENT DOCUMENTS

| | | |
|---|---|---|
| DE | 3913124 | 6/1989 |
| DE | 4316474 | 11/1994 |
| EP | 0994300 | 4/2000 |
| GB | 1420027 | 1/1976 |

* cited by examiner

*Primary Examiner*—Ted Kim
(74) *Attorney, Agent, or Firm*—Timothy J. Klima

(57) ABSTRACT

A fuel injection device for a gas turbine includes an airflow passage 1 whose walls 2 are provided with at least one fuel opening 3 for the injection of fuel into the airflow, with the center axes 4 of the fuel openings 3 being inclined at least in a circumferential direction.

7 Claims, 2 Drawing Sheets

HOMOGENOUS MIXTURE FORMATION BY SWIRLED FUEL INJECTION

This application claims priority to German Patent Application DE10340826.6 filed Sep. 4, 2003, the entirety of which is incorporated by reference herein.

BACKGROUND OF THE INVENTION

This invention relates to a fuel injection device for a gas turbine. More particularly, this invention relates to a fuel injection device for a gas turbine with an airflow passage whose walls are provided with several fuel openings for the injection of fuel into the airflow.

A great variety of methods are used to prepare the fuel-air mixture in gas turbine combustion chambers, with distinction being basically made between their application to stationary gas turbines or aircraft gas turbines and the respective specific requirements.

However, in order to reduce pollutant emissions, in particular nitrogen oxide emissions, the fuel must generally be premixed with as much air as possible to obtain a lean combustion state, i.e. one characterized by air excess. Such a mixture is, however, problematic since it may affect the combustion-stabilizing mechanisms.

Combustion is almost exclusively stabilized by swirling air which enables the partly burnt gases to be re-circulated. Fuel is in many cases introduced centrally by means of a nozzle arranged on the center axis of the atomizer. Here, fuel is in many cases injected into the airflow with considerable overpressure to achieve adequate penetration and premix as much air as possible with fuel. These pressure atomizers are intended to break up the fuel directly. However, some designs of injection nozzles are intended to spray the fuel as completely as possible onto an atomizer lip. The fuel is accelerated on the atomizer lip by the airflow, broken up into fine droplets at the downstream end of this lip and mixed with air.

Another possibility to apply the fuel onto this atomizer lip is by way of a so-called 'film applicator', with the fuel being distributed as uniformly as possible as a film.

A further possibility to mix the fuel with maximum intensity with a great quantity of air is by de-central injection from the outer rim of the flow passage which carries the major quantity of air. This can be accomplished from an atomizer lip, but also from the outer nozzle contour. Different to the film applicator, this type of injection is characterized by a defined penetration of the fuel into the main airflow.

Both the injection of fuel by means of a central nozzle or a pressure atomizer and the introduction as a film by way of a film applicator are to be optimized such that a maximum amount of the air passing the atomizer, if possible the entire air, is homogeneously mixed with fuel prior to combustion. Characteristic of a low-pollutant, in particular, low-nitrogen oxide combustion, is the preparation of a lean fuel-air mixture, i.e. one premixed with air excess. The consequence of this is fuel nozzles whose flow areas are large enough to enable the high quantity of air to be premixed with fuel. Due to the size of these fuel nozzles and, if central injection is used, the limited ability of the fuel jets or sprays to penetrate the constantly increasing sizes of air passages and produce a homogenous distribution of the fuel-air mixture, novel concepts of fuel injection and pre-mixture are required.

Homogenous distribution and introduction of fuel in large airflow passages calls for de-central injection from a maximum number of fuel openings to be arranged on the airflow passage walls. Due to their great number, however, the openings will be very small, as a result of which they may be blocked or clogged by contaminated fuel. Since these burners are frequently cut in at higher engine loads, blockage may also be caused by fuel degradation products if, after intermediate or high-load operation, burner operation via these fuel openings is cut out and the fuel remaining in the fuel nozzle is heated up and degraded. Typical of the fuel nozzles is, in many cases, a very irregular velocity and mass flow distribution in the radial direction. Due to the swirling air, which is required to stabilize the subsequent combustion, the local airflows are at maximum in the area of the radially outer limiting wall. If fuel is introduced into the airflow via a small number of openings, the circumferential homogeneity of the fuel in the air is, on the one hand, affected and, on the other hand, the fuel can penetrate very deeply into the flow and mix and vaporize in regions in which air is not sufficiently available. This may occur, in particular, with de-central injection, as described above.

BRIEF SUMMARY OF THE INVENTION

The present invention, in a broad aspect, provides a fuel injection device of the type discussed above which, while being simply designed and reliable, avoids disadvantages of the state of the art and ensures an optimized mixture of fuel and air.

It is a particular object of the present invention to provide solution to the above problems by a combination of the features described herein. Further advantageous embodiments of the present invention will be apparent from the description below.

Accordingly, the present invention provides for an inclination of the center axes of the fuel openings at least in the circumferential direction.

Firstly, the present invention eliminates the disadvantages resulting from a small number of fuel openings. The disadvantages of the state of the art are the irregular fuel distribution in the circumferential direction of the fuel nozzle and an excessive depth of penetration of the fuel into the main flow. Secondly, the present invention eliminates the need for a high number of very small fuel openings which, due to their size, are susceptible to clogging. The present invention accordingly provides for a technically feasible fuel supply arrangement which, while featuring a small number of fuel openings, ensures good homogeneity of the air-fuel mixing process.

The present invention, therefore, provides for the introduction of fuel from the outer rim into the airflow via a small number of circumferentially inclined openings. The swirl of the fuel, which can be introduced by the principle of co-rotation or contra-rotation in relation to the swirled airflow, enables the fuel to penetrate, through relatively large openings, to a penetration depth in the air zones which is defined by the swirl and produce a mixture of maximum homogeneity. Since the regions of high air velocity and, therefore, high local air mass flows occur in the wall-near area of the outer wall of the swirled airflow, both, the number of fuel openings is reduced and the penetration depth controlled.

The center axes of the fuel openings may additionally also be inclined in the axial direction.

The advantage of the present invention is a practical solution to the problem of homogeneously premixing fuel with air while achieving a defined, not too deep penetration of the fuel into the airflow with a minimum number of relatively large fuel openings. The general object is the reduction of the nitrogen oxide emission of the gas turbine combustion chamber by means of a robust, technically implementable fuel injection configuration.

BRIEF DESCRIPTION OF THE DRAWINGS

The present invention is more fully described in light of the accompanying drawings showing preferred embodiments. In the drawings.

DETAILED DESCRIPTION OF THE INVENTION

Figure 1:
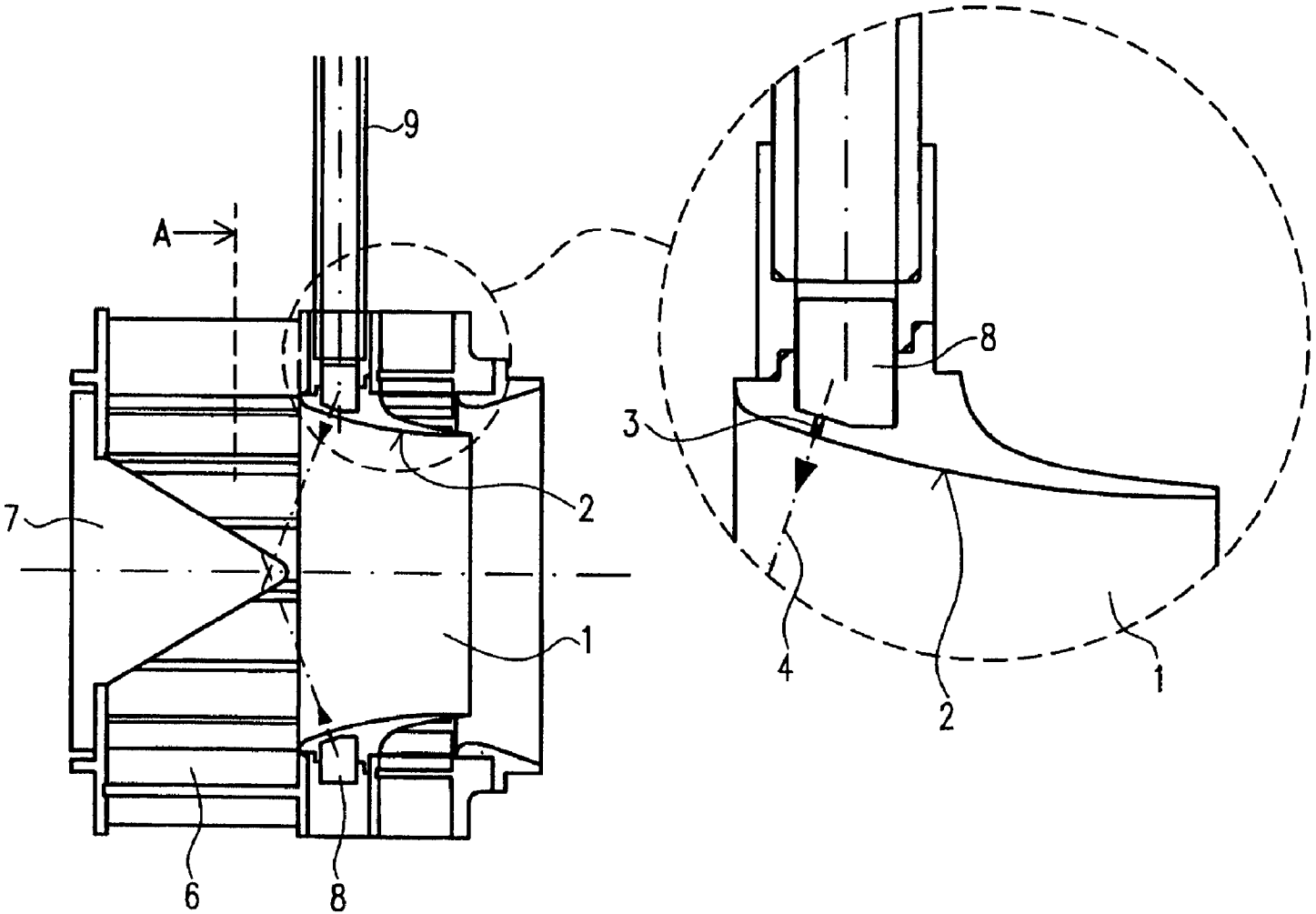
FIG. 1 shows a schematic partial view plus an enlarged representation of a fuel nozzle with de-central injection in accordance with the present invention.

FIG. 1 shows a fuel nozzle according to the present invention, which comprises a flow passage 1 to which an airflow (not detailed) is supplied via a swirler 6, this swirler 6 imparting a swirl to the airflow. A centric cone 7 is used for airflow orientation and could additionally feature at least one further fuel injection nozzle. Fuel is supplied to a fuel annulus 8 via at least one fuel line 9. A passage wall 2 (see enlarged representation in FIG. 1) has several fuel openings 3, whose center axes 4 are all inclined against the airflow in the flow passage 1, as illustrated in FIG. 1.

Figure 2:
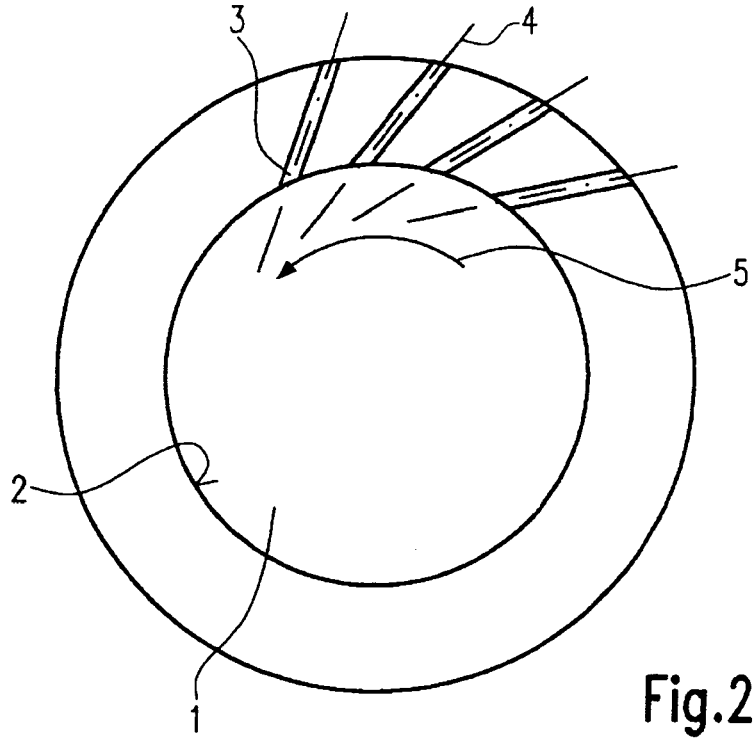
FIG. 2 is a partial sectional view of the arrangement shown in FIG. 1, with the sectional direction being conical along the respective center axes of the fuel openings.
Figure 3:
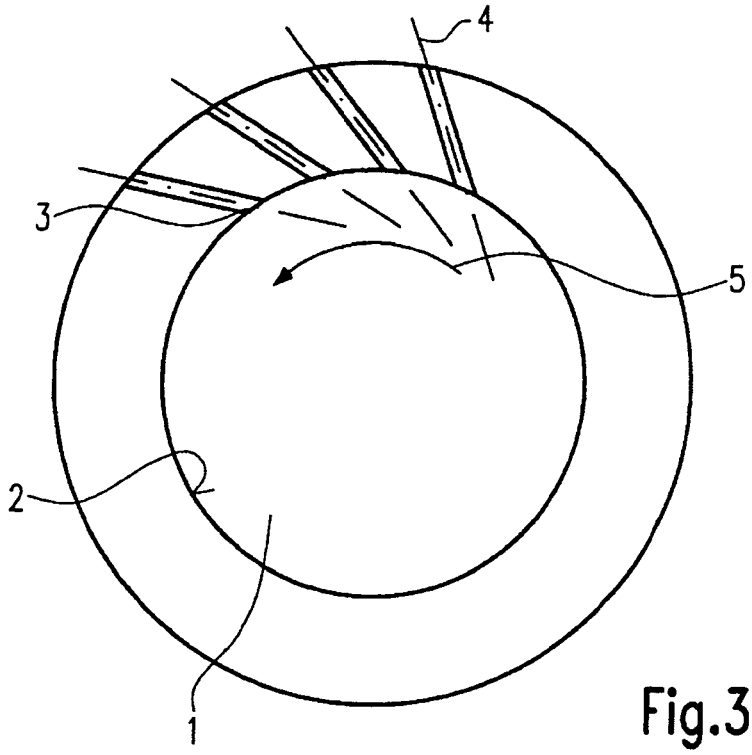
FIG. 3 is a sectional view, analogously to FIG. 2, of a modified embodiment of the present invention.

FIGS. 2 and 3 show inventive variants of the arrangement of the center axes 4 of the fuel openings 3. These are circumferentially inclined, so that they are tangential to a centric circle not further illustrated. FIG. 2 shows an arrangement in which the fuel is injected with a co-rotational swirl in relation to the swirl direction 5 of the airflow, while FIG. 3 shows an embodiment in which the center axes 4 of the fuel openings are arranged such that the fuel is injected with a contra-rotational swirl in relation to the swirl direction 5 of the airflow.

The present invention is not confined to the embodiments shown; rather, the inclination angle of the center axes 4 of the fuel openings 3 is variable in the framework of the present invention, either individually, or in one or more groups. This applies similarly to the number and the diameters of the fuel openings 3 as well as to the corresponding fuel passages. Within the present invention, several inventive fuel injection arrangements can be provided in axial stagger, which can also be combined relative to each other in counter-direction of injection. Furthermore, the present invention is combinable with a great variety of other forms of fuel injection.

| List of reference numerals | |
|---|---|
| 1 | Flow passage |
| 2 | Passage wall |
| 3 | Fuel opening |
| 4 | Center axis of fuel opening 3 |
| 5 | Swirl direction of airflow |
| 6 | Swirler |
| 7 | Cone |
| 8 | Fuel annulus |
| 9 | Fuel line |

What is claimed is:

1. A fuel injection device for a gas turbine, comprising:

an airflow passage having an outer annular wall, a main stream of the airflow through the fuel injection device passing through the airflow passage within the outer annular wall, an air swirler positioned to swirl the main stream of the airflow and which thereby creates a high local air mass flow positioned at a radially outward portion of the main stream of the airflow near the outer annular wall, a plurality of fuel openings positioned on the outer annular wall of the airflow passage, downstream of the air swirler, for the injection of liquid fuel into the main stream of the airflow, wherein, a center axis of each fuel opening is inclined in a circumferential direction and also inclined axially against the main stream of the airflow such that the liquid fuel is injected radially inwardly, axially upstream and with a circumferential component to a controlled penetration depth within the high local air mass flow.

2. A fuel injection device in accordance with claim 1, wherein at least some of the center axes of the fuel openings are inclined in a direction of a swirl of the airflow to inject the fuel into the high local air mass flow with a circumferential component in the direction of swirl of the airflow.

3. A fuel injection device in accordance with claim 2, wherein at least some of the center axes of the fuel openings have different relative inclinations than others of the center axes to inject the fuel into the high local air mass flow at different circumferential inclinations with respect to one another.

4. A fuel injection device in accordance with claim 1, wherein at least some of the center axes of the fuel openings are inclined against a direction of a swirl of the airflow to inject the fuel into the high local air mass flow with a circumferential component against the direction of swirl of the airflow.

5. A fuel injection device in accordance with claim 4, wherein at least some of the center axes of the fuel openings have different relative inclinations than others of the center axes to inject the fuel into the high local air mass flow at different circumferential inclinations with respect to one another.

6. A fuel injection device in accordance with claim 1, wherein at least some of the center axes of the fuel openings have different relative inclinations than others of the center axes to inject the fuel into the high local air mass flow at different circumferential inclinations with respect to one another.

7. A fuel injection device in accordance with claim 1, wherein all of the center axes of the plurality of fuel openings have the same relative inclinations to inject the fuel into the high local air mass flow at a same circumferential inclination with respect to one another.

* * * * *